US005879273A

United States Patent [19]

Wei et al.

[11] Patent Number: 5,879,273

[45] Date of Patent: Mar. 9, 1999

[54] WHEEL-TYPE RESISTANCE DEVICE FOR A BICYCLE EXERCISER

[76] Inventors: Mike Wei, No. 229, Lane 75, Sec. 3, Kang-Ning Rd., Nei-Hu Dist., Taipei City; Sheng-Jung Wu, No. 64, Alley 60, Lane 632, Sec. 3, Chang-Hsin Rd., Ho-Mei Chen, Chang-Hua Hsien, both of Taiwan

[21] Appl. No.: 89,877

[22] Filed: Jun. 3, 1998

[51] Int. Cl.[6] ..... A63B 22/06; F16F 15/03

[52] U.S. Cl. ..... 482/63; 482/903; 188/164

[58] Field of Search ..... 482/57, 63, 5, 482/6, 92, 903; 188/164, 267, 158, 159; 310/105

[56] References Cited

U.S. PATENT DOCUMENTS

| | | | |
|---|---|---|---|
| 4,146,806 | 3/1979 | Katsumata | 310/153 |
| 4,550,697 | 11/1985 | Campen | 123/149 D |
| 5,072,930 | 12/1991 | Sun | 482/63 |
| 5,096,024 | 3/1992 | Wu | 188/164 |
| 5,234,083 | 8/1993 | Lee | 188/159 |
| 5,236,069 | 8/1993 | Peng | 482/63 |
| 5,247,854 | 9/1993 | Wu | 482/63 |
| 5,586,624 | 12/1996 | Ko et al. | 482/63 |

*Primary Examiner*—Stephen R. Crow
*Attorney, Agent, or Firm*—Christensen O'Connor Johnson & Kindness PLLC

[57] ABSTRACT

A wheel-type resistance device includes a flywheel which is rotated together with a hub member around an axle and which has an accommodation chamber indented axially to form a first circumferential portion that extends in a radial direction relative to the axle. A plurality of magnetically attractive members have magnetically permeable members thereon and are angularly displaced on the first circumferential portion. A dragging force adjusting member is mounted on the axle and is shiftable in the axial direction. The adjusting member has a left major surface with a second circumferential portion opposing the first circumferential portion for mounting a plurality of magnets so that the magnets will be drawn by the magnetically attractive members through the permeable members when the flywheel rotates. A shifting member is operable to shift the adjusting member away from the flywheel so as to decrease the dragging force imposed upon the rotation of the flywheel. A coil spring biases the adjusting member toward the flywheel against the action of the shifting member.

7 Claims, 6 Drawing Sheets

WHEEL-TYPE RESISTANCE DEVICE FOR A BICYCLE EXERCISER

BACKGROUND OF THE INVENTION

1. Field of the Invention

This invention relates to a resistance device for a bicycle exerciser, more particularly to a wheel-type resistance device which provides a magnetic resisting force between a flywheel and a dragging force adjusting member thereof.

2. Description of the Related Art

Referring to FIGS. 1 and 2, a conventional wheel-type resistance device of a bicycle exerciser includes a flywheel 2 which rotates together with a hub member 9 around an axle 1. The flywheel 2 has an accommodation chamber 2*a* which is indented axially to form an inner peripheral wall 2*b* around the axle 1. Two magnetically permeable members 6 are secured on the inner peripheral wall 2*b*. A dragging force adjusting member 3 is sleeved slidably on the axle 1 and has an outer peripheral wall 3*b* provided with a plurality of arcuate magnets 7 opposite to the magnetically permeable members 6. When the hub member 9 is rotated by a pedaling action of a user to rotate the flywheel 2, the magnets 7 are drawn by the magnetically permeable members 6 to generate a magnetic dragging force.

A guiding seat 5 is secured to the exerciser and has a rail arm 5*b* which passes through a through hole 3*a* in the adjusting member 3. A cable 8 has one end 8*a* connected to the adjusting member 3, and an opposite end mounted on the bicycle exerciser and operable so as to pull the adjusting member 3 away from the flywheel 2 in the axial direction by the guidance of a guiding rail 5*b* to decrease the opposing surfaces of the magnetically permeable members 6 and the magnets 7 decrease in turn the magnetic dragging force (as shown in the dotted lines of FIG. 1). A coil spring 4 is sleeved on the axle 1 to bias the adjusting member 3 toward the flywheel 2 against the action of the cable 8.

The drawbacks of the conventional resistance device are as follows:

1. The biasing force of the coil spring 4 must be overcome when moving the adjusting member 3, thereby resulting in inconvenience during operation.
2. The size of the clearance between the inner and outer peripheral wall 2*b*, 3*b* must be very precise. A relatively large clearance will affect adversely the magnetic dragging force, and is liable to contamination.
3. The movement of the adjusting member 3 is guided only by the rail arm 5*b* and tends to be oblique relative to the axle 1, thereby resulting in possible contact between the magnets 7 and the magnetically permeable members 6, and in the generation of noise.
4. Each of the magnetically permeable members 6 is bent to be semi-circular in shape, thereby resulting in increased difficulties during manufacture and assembly.

SUMMARY OF THE INVENTION

The object of the present invention is to provide a wheel-type resistance device which can overcome the aforementioned problems commonly associated with the prior art.

According to this invention, a wheel-type resistance device includes a flywheel which is rotated together with a hub member around an axle, and which has an accommodation chamber indented axially to form a first circumferential portion that extends in a radial direction relative to the axle. A plurality of magnetically attractive members have magnetically permeable members thereon and are angularly displaced on the first circumferential portion. A dragging force adjusting member is mounted on the axle and is shiftable in the axial direction. The adjusting member has a left major surface with a second circumferential portion opposing the first circumferential portion for mounting a plurality of magnets so that the magnets will be drawn by the magnetically attractive members through the magnetically permeable members when the flywheel is rotated. The magnets are spaced apart from the magnetically permeable members with a clearance. A shifting member, such as a cable, is operable to shift the adjusting member away from the flywheel so as to decrease the dragging force imposed upon the rotation of the flywheel. A coil spring biases the adjusting member toward the flywheel against the action of the shifting member.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
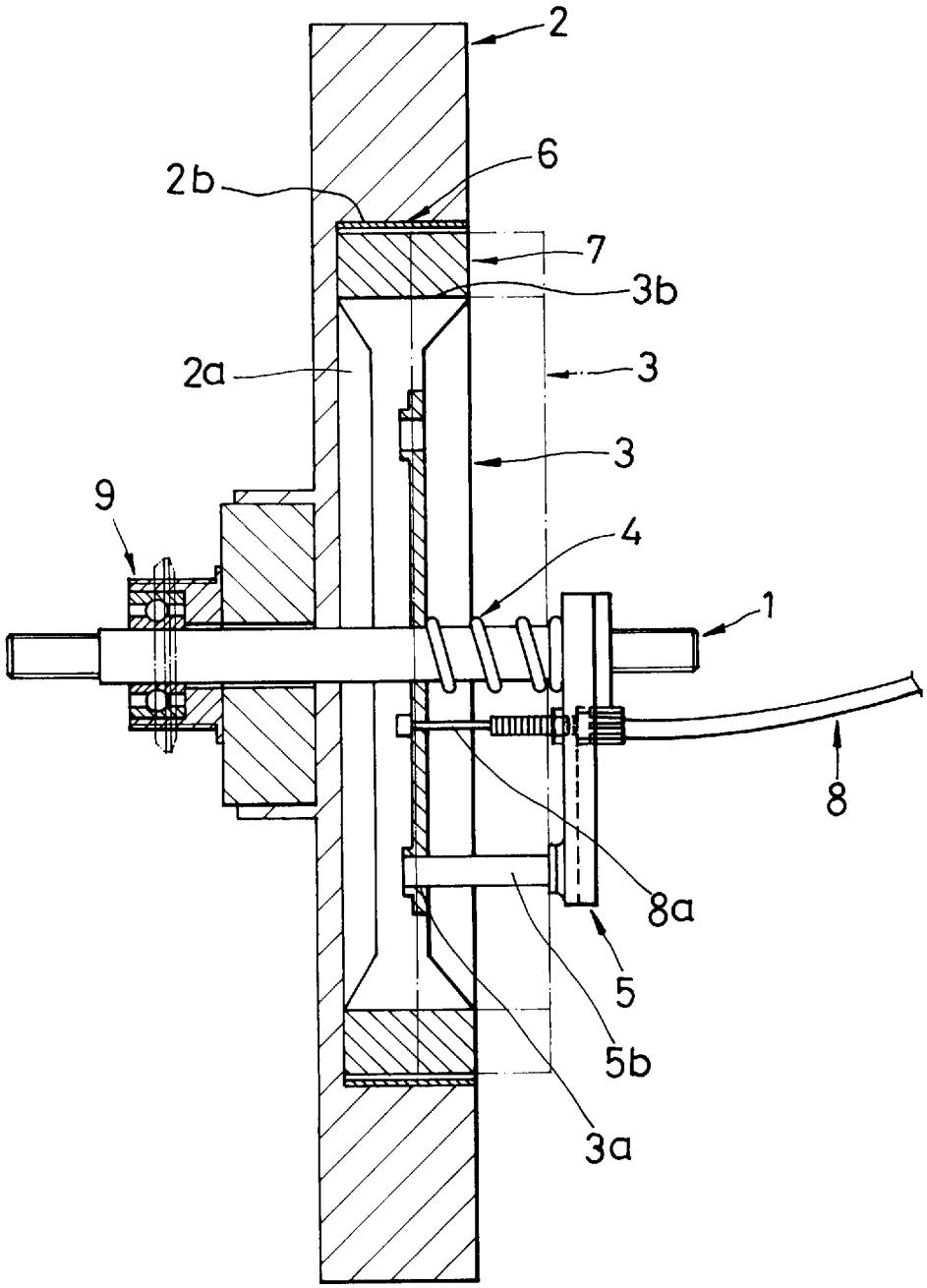
FIG. 1 PRIOR ART
FIG. 1 is a sectional view of a conventional resistance device for a bicycle exerciser.
Figure 2:
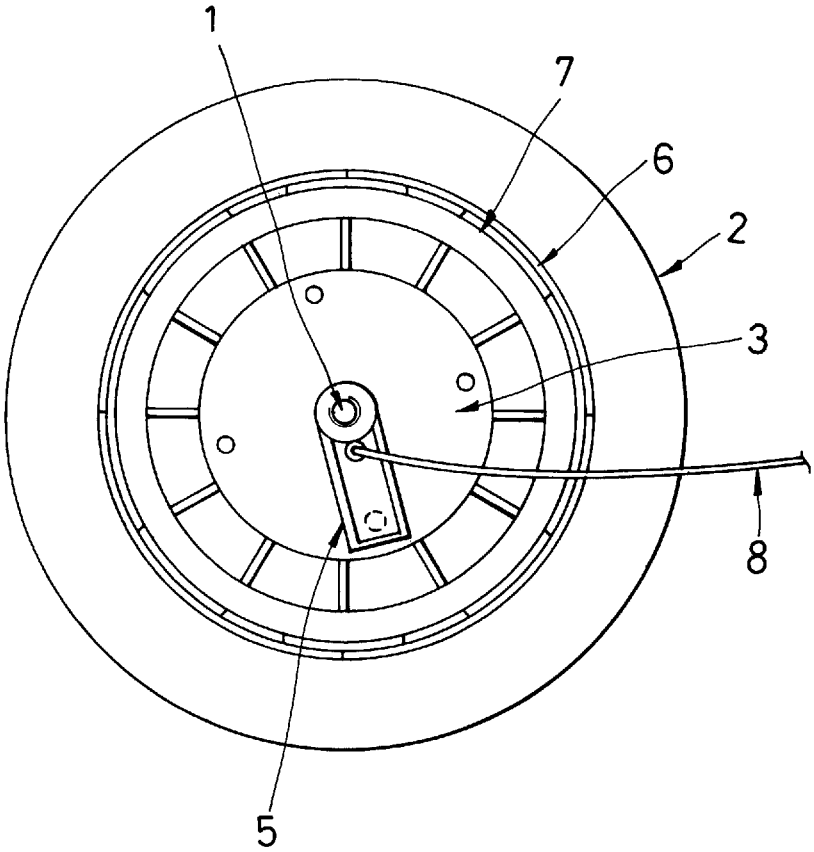
FIG. 2 PRIOR ART
FIG. 2 is a front view of the conventional resistance device.
Figure 3:
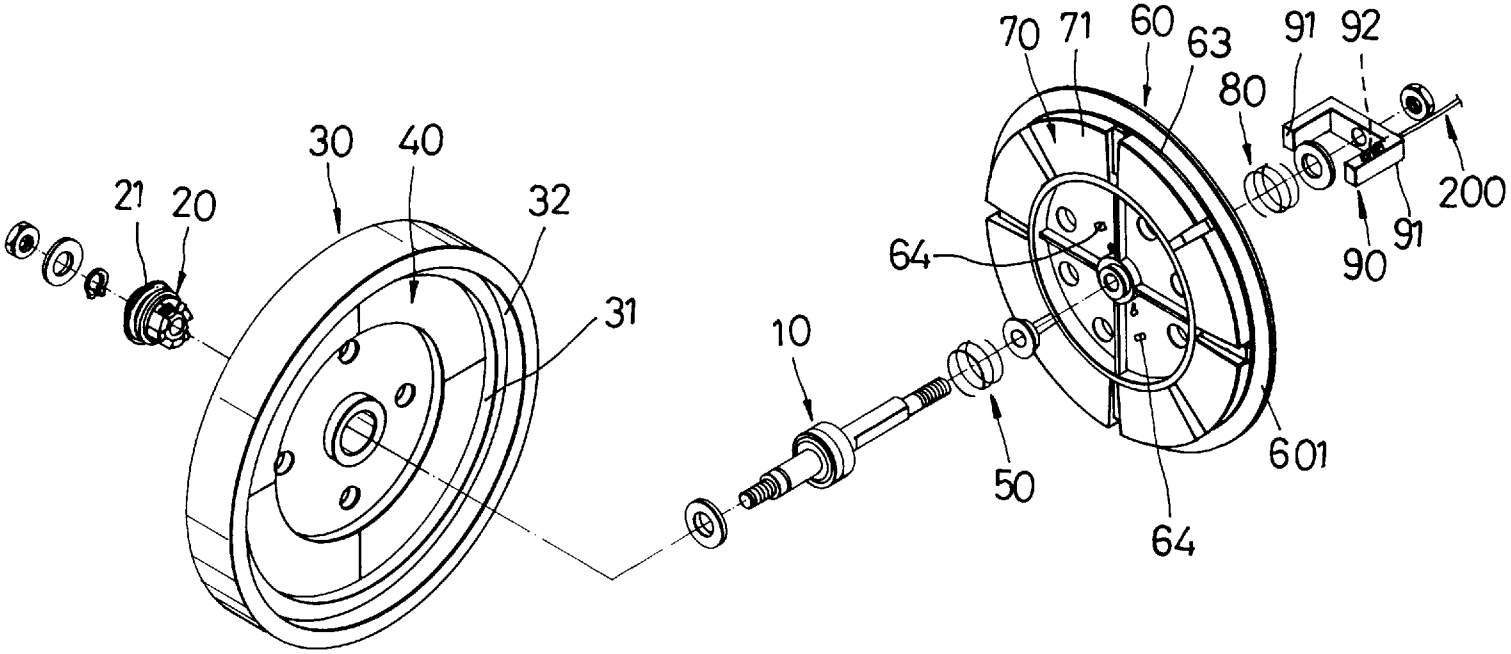
FIG. 3 is an exploded view of a preferred embodiment of a wheel-type resistance device according to this invention.
Figure 4:
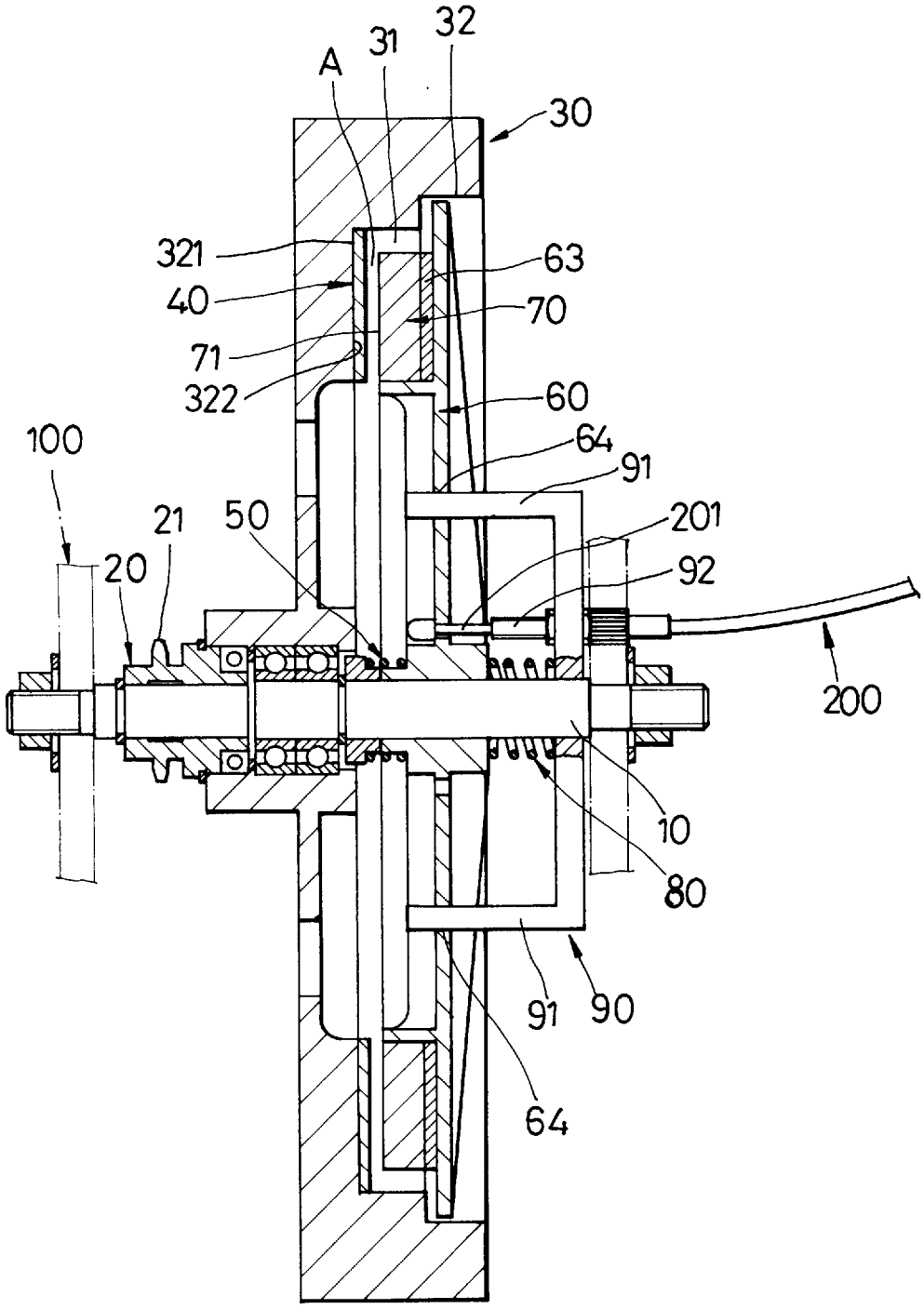
FIG. 4 is a sectional view of the preferred embodiment showing how the resistance device is mounted on the axle of an exerciser.

Referring to FIGS. 3 and 4, the preferred embodiment of a wheel-type resistance device according to the present invention is shown to be mounted on an axle 10 which is secured on a bicycle exerciser frame 100. The device comprises a flywheel 30, a dragging force adjusting member 60, eight permanent magnets 70, a guiding rail seat 90, inner coil and outer coil springs 50,80, and a cable 200.

The flywheel 30 is made of a magnetically attractive material, such as iron, and is mounted rotatably on the axle 10 for rotation together with a hub member 20 via a chain wheel 21 which is driven to rotate by a pedaling action of a user (this is known in the prior art). The flywheel 30 has a left end wall proximate to the hub member 20, and a right end wall with an accommodation chamber 31 indented axially and leftward so as to form a dragging force generating wall 32 which is spaced apart from the right end wall in an axial direction of the axle 10 and which has a first circumferential portion 321 extending in a radial direction relative to the axle 10. Four magnetically attractive members 322 are angularly provided on the first circumferential portion 321. Four arcuate magnetically permeable plates 40, which are made of aluminum, are disposed on the magnetically attractive members 322.

Figure 5:
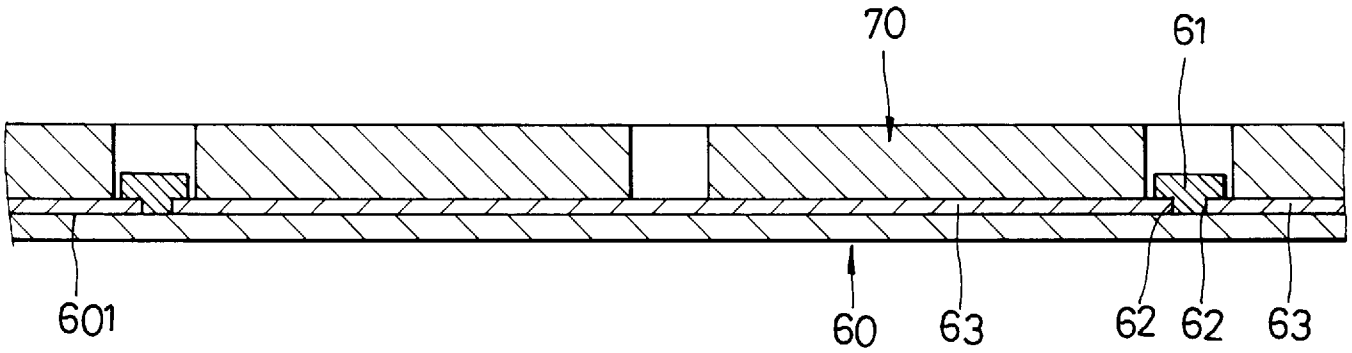
FIG. 5 is a sectional view showing how magnets are mounted onto a dragging force adjusting member.

The dragging force adjusting member 60 is made of a plastic material, and is mounted on the axle 10 to be slidable in the axial direction for moving into or out of the chamber 31. The adjusting member 60 has a right major surface distal to the flywheel 30 and a left major surface which is spaced apart from the dragging force generating wall 32 and which has a second circumferential portion 601 opposing the first circumferential portion 321. With reference to FIG. 5, the adjusting member 60 has four projections 61, each of which extends leftward from the second circumferential portion 601 and projects radially to confine two engaging slots 62 with the second circumferential portion 601. A plurality of anchoring plates 63, which are made of a magnetically attractive material, are inserted respectively into the slots 62 to be secured on the second circumferential portion 601. The anchoring plates 63 constitute an anchoring member. In addition, the adjusting member 60 is formed with two through holes 64 which extend from the left major surface to the right major surface.

The magnets 70 are secured angularly on the anchoring plates 63, and have attractive surfaces 71 opposing the magnetically permeable plates 40.

The guiding rail member 90 is secured to the axle 10 outboard to the right major surface, and includes two rail arms 91 which are displaced diametrically relative to the axle 10, which extend toward the left major surface in the axial direction, and which are parallel to each other. The rail arms 91 are inserted slidably into the through holes 64 for guiding shifting movement of the adjusting member 60 along the axial direction. A tube member 92 is threaded on the rail member 90 proximate to the axle 10.

The inner coil and outer coil springs 50,80 are compression springs that are sleeved on the axle 10. The inner coil spring 50 abuts against the right end wall of the dragging force generating wall 32 of the flywheel 30 and the left major surface of the adjusting member 60. The outer coil spring 80 abuts against the right major surface of the adjusting member 60 and the rail member 90.

The cable 200 serves as a shifting member and has one end 201 which passes through the tube member 92 for connection with the adjusting member 60, and an opposite end which is mounted on the bicycle exerciser (not shown) for connection with an actuating switch (not shown).

Referring to FIG. 4, in assembly, the adjusting member 60 is received in the chamber 31 of the flywheel 30 such that the magnetically permeable plates 40 are opposite to the attractive surfaces 71 of the magnets 70 with a clearance (A) formed therebetween. The anchoring plates 63 are provided for attracting the magnets 70 thereon so as to assist in the mounting of the magnets 70 onto the adjusting member 60. When the chain wheel 21 drives the flywheel 30 to rotate, the magnetic force of the magnets 70 permeate through the magnetically permeable plates 40 to provide a magnetic dragging force to the flywheel 30. As such, a larger pedaling force must be applied to counter the dragging force and achieve an exercising effect.

Figure 6:
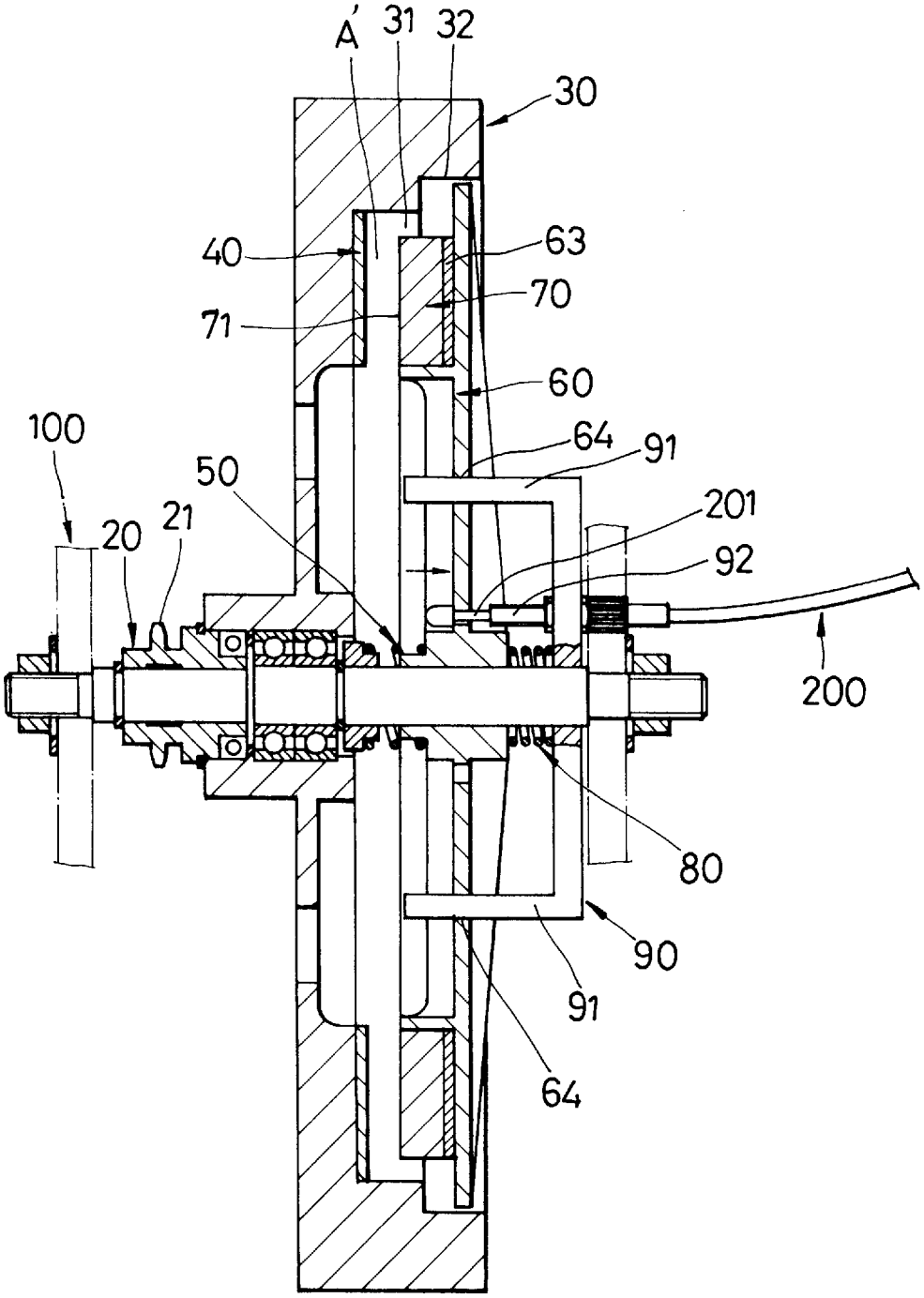
FIG. 6 is a sectional view of the preferred embodiment in an adjusted state.

Referring to FIG. 6, the cable 200 can be pulled by turning the actuating switch (not shown) to move the adjusting member 60 in the axial direction with the guidance of the rail arms 91 in order to increase the clearance (A') formed between the magnetically permeable plates 40 and the magnets 70. As such, the magnetically dragging force can be decreased to accommodate a variety of exercising requirements.

As illustrated, the magnetic dragging force is irrelevant to the distance between the outer peripheral wall of the adjusting member 60 and the inner peripheral wall of the flywheel 30, thereby addressing the foregoing problems of the prior art.

Moreover, when the magnetic dragging force is adjusted, the inner coil spring 50 can generate an opposite biasing force to counter the biasing action of the outer coil spring 80 so as to ease the actuation of the cable 200. Because of the two rail arms 91, the adjusting member 60 can be moved smoothly in the axial direction so as to prevent contact between the adjusting member 60 and the flywheel 30.

It is apparent that each of the magnetically permeable members 40 is shaped a flat plate, thereby simplifying the manufacture and assembly thereof.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. A wheel-type resistance device for providing a resisting force to a bicycle exerciser which includes an axle defining an axial direction, and a hub member mounted rotatably on the axle and driven to rotate by a pedaling action of a user, said wheel-type resistance device comprising:

a flywheel having left and right end walls, said flywheel being adapted to be mounted rotatably on the axle such that said left end wall is proximate to and is rotated together with the hub member around the axle, and such that said right end wall is distal to the hub member, said right end wall having an accommodation chamber therein indented axially and leftward so as to form a dragging force generating wall which is spaced apart from said right end wall in the axial direction and which has a first circumferential portion extending in a radial direction relative to the axle;

a plurality of magnetically attractive members angularly displaced on said first circumferential portion of said dragging force generating wall;

a plurality of magnetically permeable members provided on said magnetically attractive members;

a dragging force adjusting member adapted to be mounted on the axle and shiftable in the axial direction, said adjusting member having a left major surface which is spaced apart from said dragging force generating wall and which has a second circumferential portion opposing said first circumferential portion, and a right major surface;

a plurality of magnets angularly displaced on said second circumferential portion of said left major surface such that each of said magnets will be drawn by said magnetically attractive members through said magnetically permeable members when said flywheel is rotated, each of said magnets being spaced apart from the respective one of said magnetically permeable members with a clearance;

means for shifting said dragging force adjusting member away from said flywheel in the axial direction so as to decrease dragging force imposed upon rotation of said flywheel; and means for biasing said dragging force adjusting member toward said flywheel against action of said shifting means.

2. The wheel-type resistance device as claimed in claim 1, further comprising means for guiding shifting movement of said dragging force adjusting member along the axial direction.

3. The wheel-type resistance device as claimed in claim 2, wherein said guiding means includes a rail member adapted to be mounted fixedly on the axle and outboard to said right major surface, said rail member including at least two rail arms adapted to be displaced diametrically relative to the axle and extending toward said left major surface in the axial direction and parallel to each other, said dragging force adjusting member defining two through holes extending from said left major surface to said right major surface for slidable insertion of said two rail arms when said dragging force adjusting member is shifted in the axial direction.

4. The wheel-type resistance device as claimed in claim 3, wherein said biasing means includes an outer coil spring adapted to be sleeved on the axle and having two ends abutting respectively against said right major surface and said rail member.

5. The wheel-type resistance device as claimed in claim 4, further comprising an inner coil spring adapted to be sleeved on the axle and having two ends abutting against said right end wall and said left major surface so as to generate an opposite biasing force countering biasing action of said outer coil spring.

6. The wheel-type resistance device as claimed in claim 1, wherein said shifting means includes a cable having an end connected to said dragging force adjusting member at a position proximate to the axle, and an opposite end adapted to be mounted on said the bicycle exerciser and operable so as to pull said dragging force adjusting member away from said flywheel.

7. The wheel-type resistance device as claimed in claim 1, further comprising an anchoring member made of a magnetically attractive material and mounted securely on said dragging force adjusting member between said second circumferential portion and said magnets for attracting said magnets thereon so as to assist in mounting of said magnets onto said dragging force adjusting member.

* * * * *